US010428686B2

(12) United States Patent
Marsh et al.

(10) Patent No.: US 10,428,686 B2
(45) Date of Patent: Oct. 1, 2019

(54) AIRFOIL COOLING WITH INTERNAL CAVITY DISPLACEMENT FEATURES

(71) Applicant: Siemens Energy, Inc., Orlando, FL (US)

(72) Inventors: Jan H. Marsh, Orlando, FL (US); Stephen John Messmann, Charlotte, NC (US)

(73) Assignee: SIEMENS ENERGY, INC., Orlando, FL (US)

( * ) Notice: Subject to any disclaimer, the term of this patent is extended or adjusted under 35 U.S.C. 154(b) by 395 days.

(21) Appl. No.: 15/128,492

(22) PCT Filed: May 8, 2014

(86) PCT No.: PCT/US2014/037250
§ 371 (c)(1),
(2) Date: Sep. 23, 2016

(87) PCT Pub. No.: WO2015/171145
PCT Pub. Date: Nov. 12, 2015

(65) Prior Publication Data

US 2017/0101893 A1 Apr. 13, 2017

(51) Int. Cl.
*F01D 25/12* (2006.01)
*F01D 9/04* (2006.01)
(Continued)

(52) U.S. Cl.
CPC ..... *F01D 25/12* (2013.01); *F01D 5/08* (2013.01); *F01D 5/18* (2013.01); *F01D 5/187* (2013.01);
(Continued)

(58) Field of Classification Search
CPC ..... F01D 5/18; F01D 5/187
See application file for complete search history.

(56) References Cited

U.S. PATENT DOCUMENTS 4,183,716 A 1/1980 Takahara et al.
4,487,550 A * 12/1984 Horvath ..... F01D 5/20 416/92
(Continued)

FOREIGN PATENT DOCUMENTS

EP 0896127 A2 2/1999
EP 1793085 A2 6/2007
FR 2798422 A1 3/2001

OTHER PUBLICATIONS

PCT International Search Report and Written Opinion dated Feb. 16, 2015 corresponding to PCT Application PCT/US2014/037250 filed 108 May 14. (10 pages).

*Primary Examiner* — Richard A Edgar
*Assistant Examiner* — Brian O Peters

(57) ABSTRACT

A turbine airfoil including a central cavity defined by an outer wall including pressure and suction sides extending between and joined at leading and trailing edges, and a chordal axis extends generally centrally between the pressure and suction sides. Rib structures located in the central cavity define radial central channels extending across the chordal axis. Radial near wall passages are defined between the rib structures and each of the pressure and suction sides of the outer wall. The radial near wall passages are each open to an adjacent central channel along a radial extent of both the near wall passages and the adjacent central channel to define a radial flow pass associated with each central channel. The flow passes are connected in series to form a serpentine cooling path extending in the direction of the chordal axis.

9 Claims, 4 Drawing Sheets

(51) Int. Cl.
*F01D 5/18* (2006.01)
*F01D 5/08* (2006.01)

(52) U.S. Cl.
CPC ..... *F01D 5/188* (2013.01); *F01D 9/041* (2013.01); *F05D 2220/32* (2013.01); *F05D 2240/123* (2013.01); *F05D 2240/124* (2013.01); *F05D 2250/185* (2013.01); *F05D 2260/221* (2013.01); *F05D 2260/2214* (2013.01); *F05D 2260/22141* (2013.01)

(56) References Cited

U.S. PATENT DOCUMENTS

| | | | | |
|---|---|---|---|---|
| 4,500,258 | A | 2/1985 | Dodd et al. | |
| 5,120,192 | A | 6/1992 | Ohtomo et al. | |
| 5,392,515 | A | 2/1995 | Auxier et al. | |
| 5,484,258 | A | 1/1996 | Isburgh et al. | |
| 5,624,231 | A * | 4/1997 | Ohtomo | F01D 5/186 415/115 |
| 5,667,359 | A | 9/1997 | Huber et al. | |
| 6,478,535 | B1 | 11/2002 | Chung et al. | |
| 6,607,355 | B2 | 8/2003 | Cunha et al. | |
| 6,808,367 | B1 | 10/2004 | Liang | |
| 7,871,246 | B2 | 1/2011 | Liang | |
| 8,079,821 | B2 | 12/2011 | Campbell et al. | |
| 8,162,617 | B1 | 4/2012 | Davies et al. | |
| 8,177,488 | B2 | 5/2012 | Manteiga et al. | |
| 8,366,392 | B1 | 2/2013 | Liang | |
| 9,017,027 | B2 * | 4/2015 | Campbell | F01D 5/183 416/97 R |
| 2009/0068021 | A1 | 3/2009 | Liang | |
| 2011/0236221 | A1 | 9/2011 | Campbell | |
| 2012/0269647 | A1 | 10/2012 | Vitt et al. | |

* cited by examiner

AIRFOIL COOLING WITH INTERNAL CAVITY DISPLACEMENT FEATURES

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

The present invention is directed generally to turbine vanes, and more particularly to turbine vanes having cooling channels for conducting a cooling fluid through the vane.

BACKGROUND OF THE INVENTION

In a turbomachine, such as a gas turbine engine, air is pressurized in a compressor section then mixed with fuel and burned in a combustor section to generate hot combustion gases. The hot combustion gases are expanded within a turbine section of the engine where energy is extracted to power the compressor section and to produce useful work, such as turning a generator to produce electricity. The hot combustion gases travel through a series of turbine stages within the turbine section. A turbine stage may include a row of stationary airfoils, i.e., vanes, followed by a row of rotating airfoils, i.e., turbine blades, where the turbine blades extract energy from the hot combustion gases for powering the compressor section and providing output power. Since the airfoils, i.e., vanes and turbine blades, are directly exposed to the hot combustion gases, they are typically provided with an internal cooling passage that conducts a cooling fluid, such as compressor bleed air, through the airfoil.

One type of airfoil extends from a radially inner platform at a root end to a radially outer portion of the airfoil, and includes opposite pressure and suction sidewalls extending axially from leading to trailing edges of the airfoil. The cooling channel extends inside the airfoil between the pressure and suction sidewalls and conducts the cooling fluid in alternating radial directions through the airfoil.

SUMMARY OF THE INVENTION

In accordance with an aspect of the invention, a turbine airfoil is provided including a central cavity defined by an outer wall including pressure and suction sides extending between and joined at leading and trailing edges, and a chordal axis extends generally centrally between the pressure and suction sides. The airfoil includes rib structures located in the central cavity and defining radial central channels extending across the chordal axis. Radial near wall passages are defined between the rib structures and each of the pressure and suction sides of the outer wall, the near wall passages having an elongated dimension in a direction parallel to the chordal axis. The radial near wall passages are each open to an adjacent central channel along a radial extent of both the near wall passages and the adjacent central channel to define a radial flow pass associated with each central channel. The flow passes are connected in series to form a serpentine cooling path extending in the direction of the chordal axis.

The central channels may include a length dimension, perpendicular to the chordal axis that is greater than a width dimension of the central channel, parallel to the chordal axis.

The elongated dimension of the near wall passages may be transverse to the length dimension of the central channels.

A pair of near wall passages may be open to a common central channel on opposing sides of the chordal axis.

The rib structures may include an enlarged main body extending across the chordal axis, and a pair of connector ribs associated with each main body, the pair of connecting ribs extending from the pressure and suction sides to opposing sides of the main body.

The main bodies may each include opposing end surfaces that extend between the opposing sides and that are spaced in the chordal direction, and the flow in the serpentine cooling path passes sequentially along each of the end surfaces of each main body.

Each connecting rib may have a length dimension, in a direction perpendicular to the chordal axis, that is equal to a width dimension of an adjacent near wall passage, extending in a direction perpendicular to the chordal axis, and each connecting rib may have an axial dimension of the main body, parallel to the chordal axis, that is greater than a circumferential dimension of the main body, perpendicular to the chordal axis.

One or more of the main bodies may be formed with a hollow interior providing a flow path for cooling fluid to pass through the rib structure between flow passes of the serpentine cooling path.

In accordance with another aspect of the invention, a turbine airfoil is provided including a central cavity defined by an outer wall including pressure and suction sides extending between and joined at leading and trailing edges, and a chordal axis extends generally centrally between the pressure and suction sides. The airfoil includes rib structures located in the central cavity, each rib structure including a main body. At least two of the rib structures define first and second adjacent main bodies, and the first and second main bodies are spaced from each other in the direction of the chordal axis to define a radial central channel extending across the chordal axis. Radial near wall passages are defined between the first and second main bodies of the at least two rib structures and each of the pressure and suction sides, and the near wall passages have an elongated dimension in a direction parallel to the chordal axis. The radial near wall passages are each open to the central channel along a radial extent of both the near wall passages and the central channel.

Each rib structure may additionally include a single connecting rib extending from each of the pressure and suction sides to an associated main body of the rib structure.

The first and second main bodies may each include walls that extend in the direction of the chordal axis to opposing sides of the connecting rib, and the near wall passages may be defined between the walls of the main bodies and adjacent portions of the pressure and suction sides.

A width dimension of the central channel, parallel to the chordal axis, may be less than a length of an adjacent near wall passage, parallel to the chordal axis, from the central channel to a connecting rib defining an end of the adjacent near wall passage.

The length dimension of the adjacent near wall passage may be greater than a width dimension of the adjacent near wall passage, perpendicular to the chordal axis.

A width dimension of the central channel, parallel to the chordal axis, may be less than a width of an adjacent main body, parallel to the chordal axis.

A combined cross-sectional area of the first and second main bodies, as viewed in a plane perpendicular to the radial direction, may be greater than a combined cross-sectional area of the central channel and the near wall passages that are open to the central channel.

A serpentine cooling path may be defined between the rib structures, and the serpentine cooling path may provide a flow of cooling fluid through flow passes, each flow pass defined by both a central channel and the near wall passages that are open to an adjacent central channel.

A supplemental flow of cooling fluid may pass radially through one or more of the main bodies, wherein the supplemental flow of cooling fluid is separated from contact with the flow of cooling fluid in the serpentine cooling path.

The rib structures may be cast integrally with the pressure and suction sides of the outer wall.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
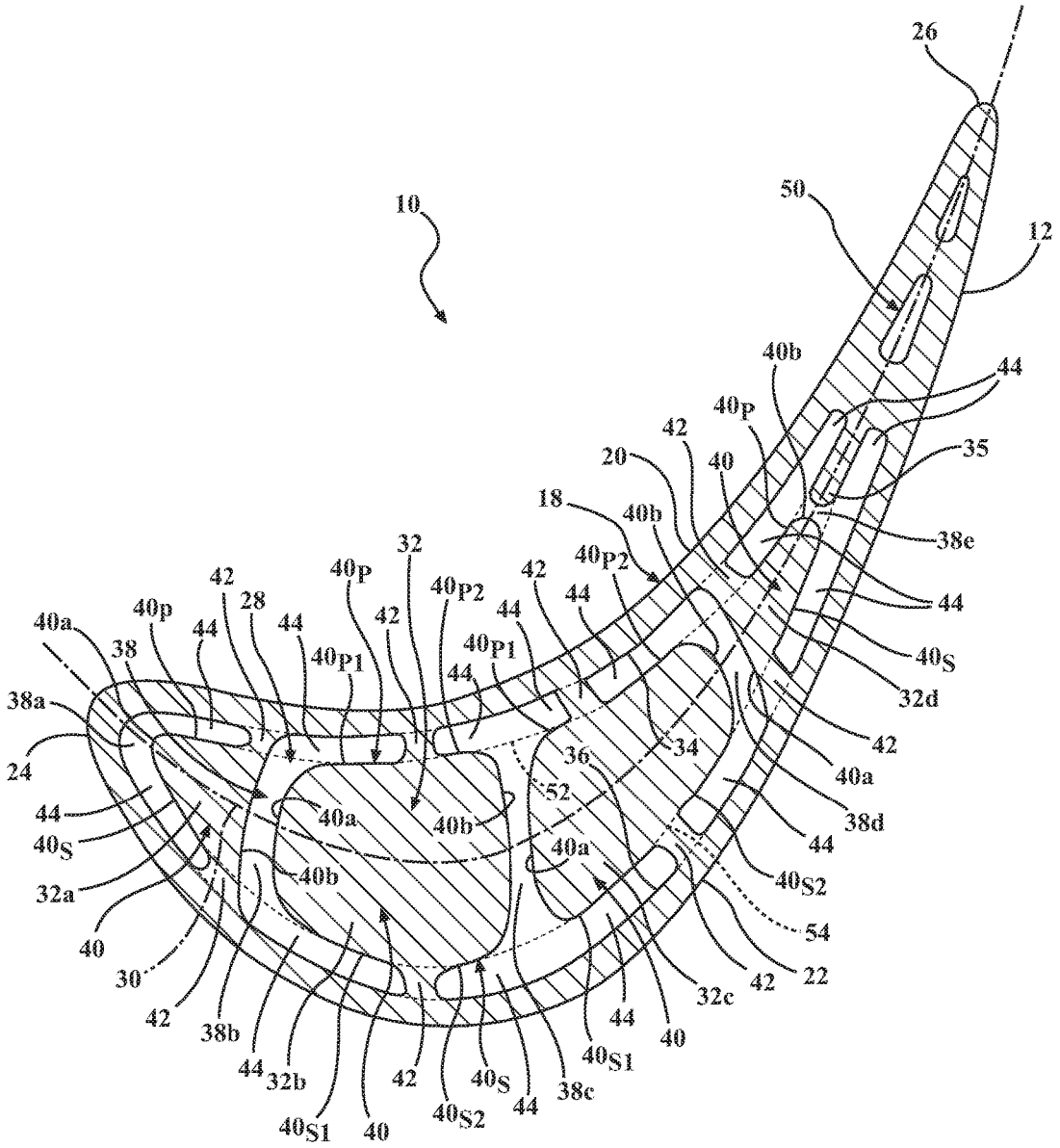
FIG. 1 is a cross-sectional view through an airfoil illustrating aspects of the present invention.

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

In accordance with an aspect of the invention, it has been observed that high pressure turbine vanes can be difficult to cool while maintaining efficient use of cooling air and minimizing adverse effects on engine efficiency. For example, in vanes that include inserts located adjacent to interior wall surfaces of the vane, air can be supplied to the insert and pass through a series of small holes in the insert to provide impingement cooling to the walls of the vane. However, it has been noted by the inventors of the present invention that, since the inserts must be separately formed, inserted into and attached within the airfoil of the vane, it is not practical and/or may be impossible to provide highly 3D profiled airfoils with impingement inserts. Additionally, post impingement air must be discharged from the spaces between the inserts and the vane walls, and may be discharged as film cooling air that mixes with the hot gas flow. Such a discharge of air can reduce the efficiency of the hot gas flow, and typically can include discharging the cooling air before the full work potential of the air to cool the vane has been utilized. In an alternative configuration it is known to provide a serpentine flow path through the vane; however, it has been observed that it can be difficult to achieve the necessary heat transfer coefficients without requiring large cooling flows or a large number of passes through smaller passages, which can also have associated reductions in efficiency. For example, an increase in the number of cooling path passes may be accomplished by increasing the number of passage dividing ribs extending between pressure and suction sides of a vane wall, but such an increase reduces the available surface area for contact with the cooling air, resulting in an associated reduction in cooling.

In accordance with aspects of the present invention, a serpentine cooling configuration is provided in an airfoil, such as may be provided to the airfoil of a vane, wherein a reduced flow area is provided to the flow passes extending radially through a cavity between outer wall pressure and suction sides of the airfoil. In particular, the reduced flow area passes are configured to displace a substantial proportion of the cooling air toward the pressure and suction sides, while also maintaining an exposed interior wall surface of the pressure and suction sides, i.e., a back side surface area of the hot walls, to provide an improved thermal design. It may be noted that, although the following description is directed to an airfoil for a stationary vane, aspects of the invention could additionally be incorporated into blades of the rotating components of the engine.

Figure 2:
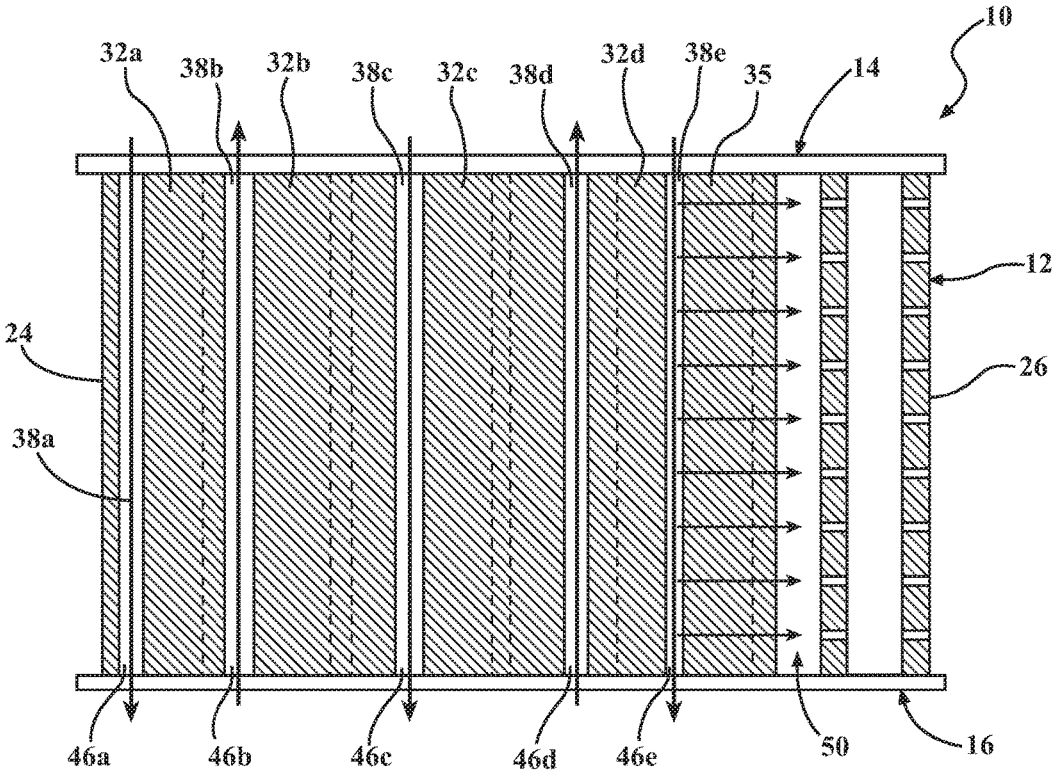
FIG. 2 is cross-sectional view taken along the chordal line in FIG. 1.

Referring to FIGS. 1 and 2, a vane 10 for a gas turbine engine is illustrated and includes an airfoil 12 located between an outer platform 14 and an inner platform 16. The airfoil 12 includes an outer wall 18 having a pressure side 20 and a suction side 22. The pressure and suction sides 20, 22 are joined at a leading edge 24 and a trailing edge 26, and define a central cavity 28 therebetween. A chordal axis 30 extends generally centrally between the pressure and suction sides 20, 22. The outer wall 18 of the airfoil 12 can be of any selected shape, including relatively complex three-dimensional (3D) shapes that can include one or more inflexions of the pressure and suction sides 20, 22 in the circumferential direction, i.e., perpendicular to the longitudinal axis of the engine.

The airfoil additionally includes rib structures 32 located in the central cavity 28 which, in accordance with aspects of the invention, are illustrated herein by first through fourth rib structures 32*a*, 32*b*, 32*c*, 32*d*. The rib structures 32 extend between inner wall surfaces 34, 36 of the respective pressure and suction sides 20, 22 of the outer wall 18 and define radial central channels 38 extending across the chordal axis 30, i.e., extending in a direction perpendicular to the chordal axis 30 between the pressure and suction sides 20, 22 and intersecting the chordal axis 30. In accordance with aspects of the invention, the central channels 38 are illustrated herein by first through fifth central channels 38*a*, 38*b*, 38*c*, 38*d*, 38*e*. It may be noted that the second, third and fourth central channels 38*a*, 38*b* and 38*c* are defined between adjacent rib structures 32; the first central channel 32*a* is defined between the first rib structure 32*a* the leading edge 24; and the fifth central channel 38*e* is defined between the fourth rib structure 32*d* and an aft rib portion 35.

The rib structures 32 are each defined by an enlarged portion or main body 40, and each main body 40 is supported to both the pressure side 20 and the suction side 22 by a single connecting rib 42 extending from the main body 40 to each of the pressure and suction sides 20, 22, wherein the rib structures 32 and connecting ribs 42 are preferably cast integrally with the pressure and suction sides 20, 22. Each main body 40 extends relative to its respective connecting ribs 42 in the direction of the chordal axis 30 and defines opposing upstream and downstream end surfaces 40*a*, 40*b*. The spacing between the upstream and downstream end surfaces 40*a*, 40*b* in a direction parallel to the chordal axis 30 defines an axial dimension of the main body 40 that is greater than a circumferential dimension of the respective main body 40, perpendicular to the chordal axis 30.

The end surfaces 40*a*, 40*b* extend between opposing sides of the main body 40. The opposing sides of the main body 40 define pressure and suction side near walls $\mathbf{40}_P$, $\mathbf{40}_S$ that are spaced from the respective inner wall surfaces 34, 36 of the pressure and suction sides 20, 22. It may be noted that the pressure and suction side near walls $\mathbf{40}_P$, $\mathbf{40}_S$ associated with second and third rib structures 32*b*, 32*c* are defined by two portions. In particular, the pressure side near wall $\mathbf{40}_P$ of the second and third rib structures 32*b*, 32*c* includes upstream and downstream near wall portions $\mathbf{40}_{P1}$, $\mathbf{40}_{P2}$ located on either side of the connecting rib 42. Similarly, the suction side near wall $\mathbf{40}_S$ of the second and third rib structures 32*b*, 32*c* includes upstream and downstream near wall portions $\mathbf{40}_{S1}$, $\mathbf{40}_{S2}$ located on either side of the connecting rib 42.

Radial near wall passages 44 are defined between the pressure and suction side near walls $\mathbf{40}_P$, $\mathbf{40}_S$ of the rib structures 40 and the respective inner wall surfaces 34, 36 of the pressure and suction sides 20, 22 of the outer wall 18. The near wall passages 44 have an elongated, length dimension in a direction parallel to the chordal axis 30 that is greater than a width dimension of the near wall passages 44 generally perpendicular to the chordal axis 30. It may be understood that the width dimension of each of the near wall passages 44 is equal to a length of an adjacent connecting rib 42, extending between a pressure or suction side inner wall surface 34, 36 and an associated near wall $\mathbf{40}_P$, $\mathbf{40}_S$.

The second, third and fourth central channels 38*b*, 38*c*, 38*d* have an elongated, length dimension extending transverse to, i.e., generally perpendicular to, the chordal axis 30 that is greater than a width dimension extending parallel to the chordal axis 30, and the length dimension the central channels 38 is transverse to the length dimension of adjacent near wall passages 44. Further, the radial near wall passages 44 are each open to an adjacent central channel 38 along a radial extent of both the near wall passages 44 and the adjacent central channel 38, i.e., substantially the entire radial extent of the airfoil 12 between the outer and inner platforms 14, 16, to define radial flow passes 46 associated with each of the central channels 38. That is, each radial flow pass 46 is formed by both a central channel 38 and near wall passages 44, where two or more near wall passages 44 are associated with each central channel 38. For example, the second and fourth central channels 38*b* and 38*d* are each open to two near wall passages 44, one at each of the pressure and suction side ends, while the third central channel 38*c* has a pair of the near wall passages 44 associated with each end of the central channel 38*c*.

The flow passes 46 associated with each of the central channels 38*a*, 38*b*, 38*c*, 38*d*, 38*e* are identified as first through fifth flow passes 46*a*, 46*b*, 46*c*, 46*d*, 46*e*, respectively, as seen in FIG. 2. Additionally, it should be understood that the connecting ribs 42 also extend the entire radial extent of the flow passes 46 to isolate the adjacent flow passes 46 from each other.

Figure 3:
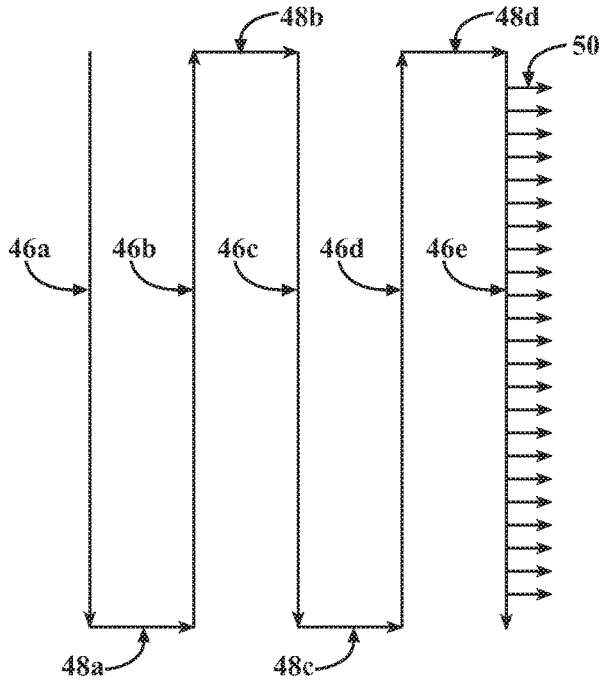
FIG. 3 is a flow diagram illustrating flow through the airfoil of FIG. 1.

As is illustrated diagrammatically in FIG. 3, the flow passes 46 are connected in series to form a five-pass serpentine cooling path extending in the direction of the chordal axis 30. In particular, the first flow pass 46*a* conveys cooling air radially inward and is connected to the second flow pass 46*b* by a first chordal connector passage 48*a* at the inner platform 16; the second flow pass 46*b* conveys cooling air radially outward and is connected to the third flow pass 46*c* by a second chordal connector 48*b* at the outer platform 14; the third flow pass 46*c* conveys cooling air radially inward and is connected to the fourth flow pass 46*d* by a third chordal connector 48*c* at the inner platform 16; the fourth flow pass 46*d* conveys cooling air radially outward and is connected to the fifth flow pass 46*e* by a fourth chordal connector 48*d*; and the fifth flow pass 46*e* conveys cooling air radially inward and is connected to trailing edge passages, generally identified as 50, for discharging the cooling air at or adjacent to the trailing edge 26.

In accordance with an aspect of the invention, the rib structures 32 are configured to substantially fill the area of the central cavity 28, with a main body area defined between imaginary lines 52, 54 extending as smooth curves connecting points along the pressure and suction side near walls $\mathbf{40}_P$, $\mathbf{40}_S$, respectively. The central channels 38 define flow channels extending across and through the central cavity 28, between the lines 52, 54 that are restricted in flow area, and preferably have a width that is about equal to the width of the near wall passages 44. The restricted flow area in the main body area between the lines 52, 54 results in displacement of cooling fluid toward the pressure and suction sides 20, 22 of the outer wall 18 to provide a different flow passage for a serpentine cooling path than known serpentine cooling arrangements. Hence, the amount of flow along the central portion of the flow paths, where flow passes without picking up heat from the outer wall 18, is limited. The different flow passage, including the near wall passages 44 with a controlled flow area adjacent to the inner wall surfaces 34, 36, creates a greater convective heat transfer at the inner wall surfaces 34, 36 while also maintaining a large exposed area for the wall surfaces 34, 36 by supporting the rib structures 32 from the relatively small cross-section connecting ribs 42. Additionally, the reduced cross section flow area provided by the flow passes 46 can provide increased engine efficiency by reducing the cooling flow requirement without reducing the convective cooling provided to the outer wall 18.

The convective heat transfer provided by the present invention can be further facilitated by providing turbulator ribs (not shown) within the flow passes 46. For example, the turbulator ribs can be configured to prevent overcooling at the upstream end of the serpentine cooling path and to provide improved heat transfer as the cooling flow passes toward the trailing edge at the opposite end of the cooling path. In particular, the number and size of the turbulator ribs can be varied along the cooling path, such as by providing an increased turbulator count, and providing larger turbulator ribs, in the downstream direction to increase the heat transfer effect of the turbulator ribs in the downstream direction of the cooling path as the cooling air warms, to thereby enable the heated cooling air to remove an adequate amount of heat from the outer wall in the downstream direction. Also, it should be understood that other heat transfer coefficient enhancing features may be implemented to provide improved heat transfer between the heated cooling air and the outer wall 18 as the flow passes downstream through the serpentine cooling path.

By providing an improved flow configuration with improved heat transfer, it is believed that the serpentine flow path can be formed without film cooling holes in at least the second through the fifth flow passes 46*b*, 46*c*,46*d*, 46*e*, only providing cooling passages from the first flow pass to the exterior of the leading edge 24. Hence, the amount of cooling air required for the cooling path is further reduced by elimination of the film cooling along the pressure and suction sides 20, 22, and losses associated with discharging film cooling air into the hot gas flow are also reduced to reduce efficiency losses for the engine.

Figure 4:
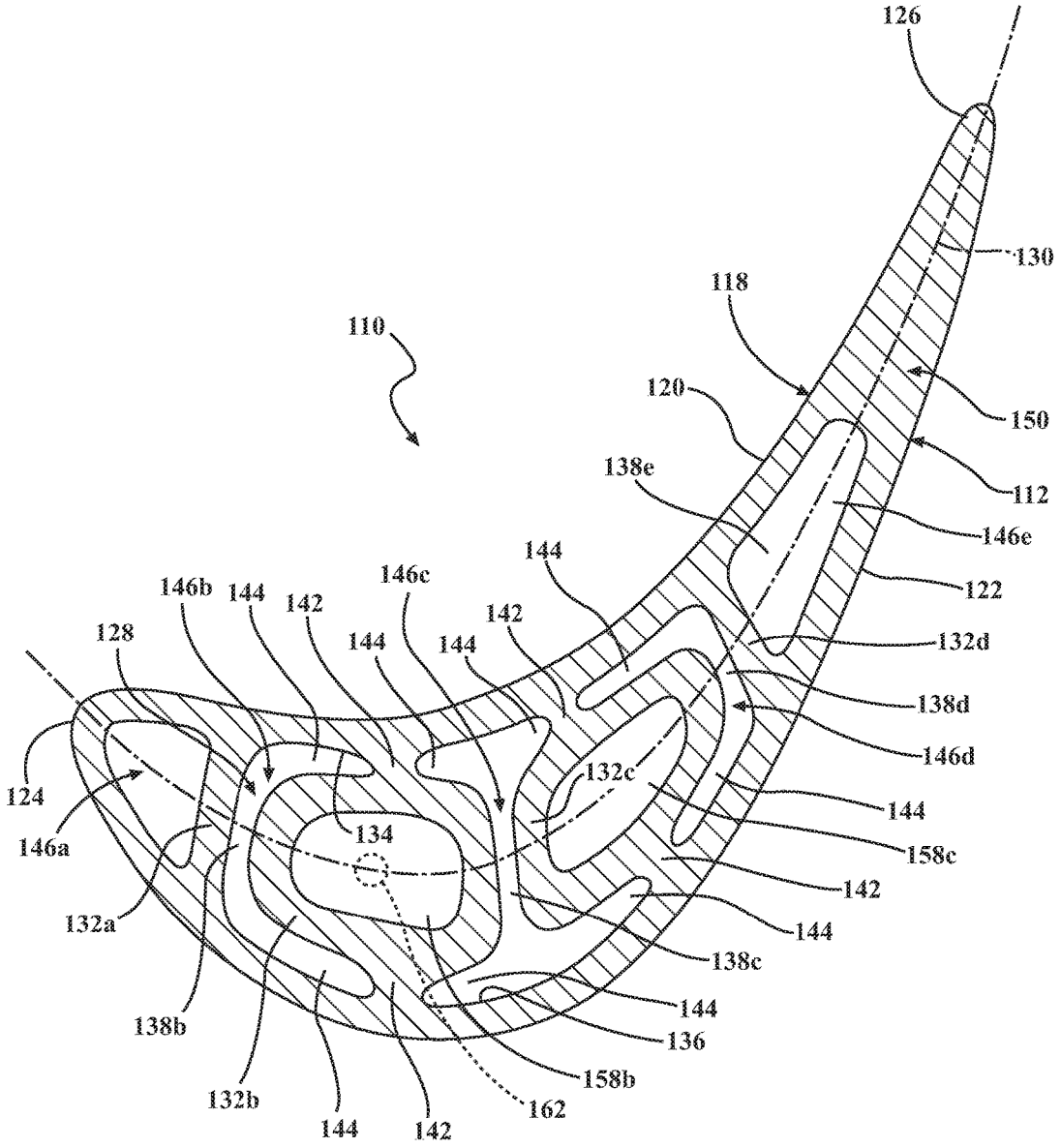
FIG. 4 is a cross-sectional view through an alternative configuration of an airfoil illustrating aspects of the present invention.
Figure 5:
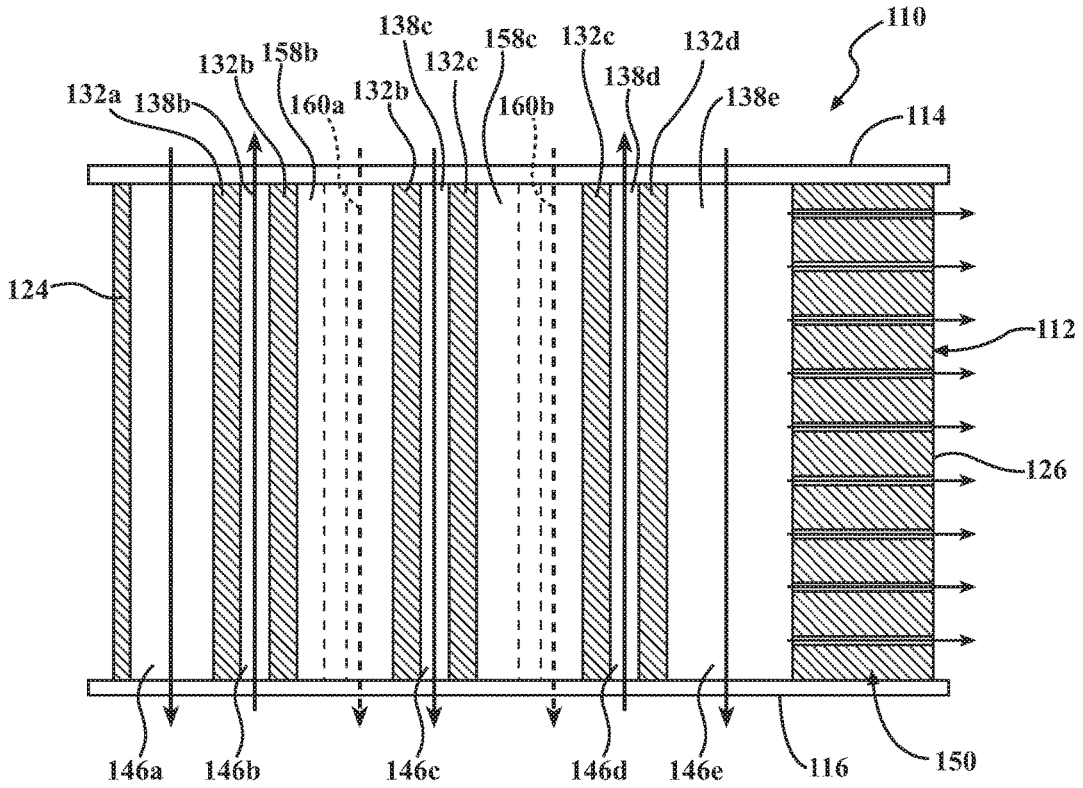
FIG. 5 is cross-sectional view taken along the chordal line in FIG. 4.

Referring to FIGS. 4 and 5, an alternative configuration for the vane is illustrated wherein elements corresponding to elements described for the configuration of FIGS. 1-3 are labeled with the same reference numerals increased by 100.

As seen in FIG. 4, a vane 110 is illustrated including a five-pass serpentine cooling circuit formed by first through fifth flow passes 146*a*, 146*b*, 146*c*, 146*d*, 146*e*. The second through fourth flow passes 146*b*, 146*c*, 146*d* are each defined by a respective central channel 138*b*, 138*c*, 138*d* with open connections to respective near wall passages 144. In the current configuration, the first and fifth flow passes 146*a*, 146*e* are formed without enlarged ring structures, in that the rib structures 132*a* and 132*d* are configured as generally narrow ribs, having parallel sides extending the entire distance between the pressure and suction sides 120, 122 of the outer wall 118. However, it may be understood that the distance between the pressure and suction sides 120, 122 at the end passes 146*a* and 146*e* is narrower than through the central passes, such that the necessity for decreasing the cross-sectional flow area may be reduced. In addition, the first and fifth flow passes 146*a*, 146*e* illustrate a general aspect of the invention, when viewed in comparison to the configuration of FIG. 1, wherein it can be seen that the reduced flow areas of the present invention can be provided to select locations within the vane on an as-needed basis, depending on the cooling requirements of a particular vane configuration.

Figure 6:
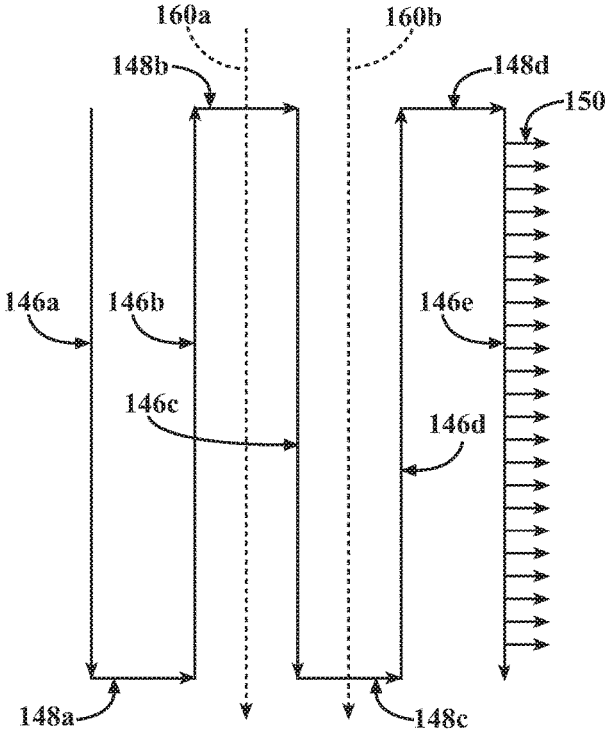
FIG. 6 is a flow diagram illustrating flow through the airfoil of FIG. 4.

In accordance with a further aspect of the invention, the second and third rib structures 132*b*, 132*c* comprise first and second adjacent rib structures that are each formed with a respective secondary passage 158*b*, 158*c*, such that the rib structures 132*b*, 132*c* are configured with a hollow interior. The passages 158*b*, 158*c* are isolated from fluid communication with the flow in the serpentine flow path and, in particular, are isolated from the cooling air flow passing through the second through fourth flow passes 146*b*, 146*c*, 146*d*. Provision of the secondary passages 158*b*, 158*c* results in less thermal mass for the rib structures 132*b*, 132*c*. Additionally, the passages 158*b*, 158*c* can provide paths for respective supplemental flows of cooling air 160*a*, 160*b* from the outer diameter to the inner diameter of the vane 110, as illustrated in FIGS. 5 and 6, while the cooling path for cooling the outer wall 118 can comprise a five-pass cooling path corresponding to the cooling path described with reference to FIG. 3. It may be understood that the supplemental flows of cooling air 160*a*, 160*b* are thermally isolated from the outer wall 118 to provide the function of transferring the cooling air 160*a*, 160*b* from one end of the vane 110 to the other without taking on a significant amount of heat. Since the passages 158*b*, 158*c* are isolated from the outer wall 118, one or both of the secondary passages 158*b*, 158*c* can also form a thermally insulated passage for a component, such as a thermocouple, as illustrated diagrammatically by 162 in FIG. 4.

The configurations described herein allow complex airfoil designs while implementing a cooling configuration capable of providing sufficient cooling. For example, the rib structures 32, 132 described herein can be cast in place with formation of the airfoil 12, 112, whereas configurations that rely on inserted features, such as inserted impingement plates or insulated jumper tubes, are generally limited by assembly constraints, including a requirement that the interior central cavity of the vane be sufficiently straight to permit passage of an inserted component. Hence, the present configuration can permit formation of optimal airfoil shapes, with complex 3D shapes, without constraints imposed by cooling passage assembly limitations. Additionally, the vane configurations described herein can provide significant structural benefits that have not been realized by prior cast airfoil designs.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine airfoil including a central cavity defined by an outer wall including pressure and suction sides extending between and joined at leading and trailing edges, and a chordal axis extending generally centrally between the pressure and suction sides, the airfoil including: rib structures located in the central cavity and defining radial central channels, wherein each radial central channel extends across the chordal axis, wherein the rib structures include an enlarged main body extending across the chordal axis, wherein an axial dimension of the main body, parallel to the chordal axis, is greater than a circumferential dimension of the main body, perpendicular to the chordal axis; radial near wall passages defined between the rib structures and each of the pressure and suction sides of the outer wall, the near wall passages having an elongated dimension in a direction parallel to the chordal axis, the radial near wall passages are each open to an adjacent central channel along a radial extent of both the near wall passages and the adjacent central channel to define a radial flow pass associated with each central channel; the flow passes are connected in series to form a serpentine cooling path extending in the direction of the chordal axis, wherein at least one of the flow passes has a U-shaped flow cross-section defined by the respective near wall passages and the respective central channel.

2. The airfoil of claim 1, wherein each of the central channels includes a length dimension, perpendicular to the chordal axis that is greater than a width dimension of the central channel, parallel to the chordal axis.

3. The airfoil of claim 2, wherein the elongated dimension of the near wall passages is transverse to the length dimension of the central channels.

4. The airfoil of claim 1, wherein a pair of near wall passages are open to a common central channel on opposing sides of the chordal axis.

5. The airfoil of claim 1, wherein the rib structures include a pair of connector ribs associated with each main body, the pair of connecting ribs extending from the pressure and suction sides to opposing sides of the main body.

6. The airfoil of claim 5, wherein the main bodies each include opposing end surfaces that extend between the opposing sides and that are spaced in the chordal direction, and the flow in the serpentine cooling path passes sequentially along each of the end surfaces of each main body.

7. The airfoil of claim 5, wherein:

each connecting rib has a length dimension, in a direction perpendicular to the chordal axis, that is equal to a width dimension of an adjacent near wall passage, extending in a direction perpendicular to the chordal axis.

8. The airfoil of claim 5, wherein one or more of the main bodies are formed with a hollow interior providing a supplemental cooling path for cooling fluid to pass radially through the rib structure between flow passes of the serpentine cooling path, the supplemental cooling path being separated from contact with the flow of cooling fluid in the serpentine cooling path.

9. The airfoil of claim 8, wherein the airfoil is a stationary vane, wherein the supplemental cooling path defined by the hollow interior extends from an outer diameter to an inner diameter of the vane.

* * * * *